United States Patent [19]

Rutter et al.

[11] Patent Number: 4,766,363

[45] Date of Patent: Aug. 23, 1988

[54] VOLTAGE LIMITING CONTROL SYSTEM FOR HEAT EMITTING LOADS

[75] Inventors: Robert E. Rutter, Tempe, Ariz.; Robert M. Jensen, Albuquerque, N. Mex.

[73] Assignee: Devore Aviation Corporation, Albuquerque, N. Mex.

[21] Appl. No.: 55,294

[22] Filed: May 29, 1987

[51] Int. Cl.[4] ..... G05F 1/40

[52] U.S. Cl. ..... 323/243; 323/239; 323/244

[58] Field of Search ..... 323/238, 239, 241–244; 361/100

[56] References Cited

U.S. PATENT DOCUMENTS

| | | | |
|---|---|---|---|
| 3,414,798 | 12/1968 | Nielsen | 323/242 X |
| 3,599,082 | 8/1971 | Besier | 323/242 |
| 3,646,439 | 2/1972 | Broski | 323/242 |
| 4,360,783 | 11/1982 | Nagasawa et al. | 323/243 X |
| 4,379,254 | 4/1983 | Hurban | 323/243 X |
| 4,688,161 | 8/1987 | Covington | 363/37 |

*Primary Examiner*—Patrick R. Salce
*Assistant Examiner*—Marc S. Hoff
*Attorney, Agent, or Firm*—Fleit, Jacobson, Cohn & Price

[57] ABSTRACT

Power from an AC source is applied to a load under control of a power switching triac in response to signals from a feedback loop isolated from line voltage transients by means of a pair of opto-coupling devices respectively connecting the feedback loop to a load voltage sensor and the control electrode of the triac.

16 Claims, 2 Drawing Sheets

VOLTAGE LIMITING CONTROL SYSTEM FOR HEAT EMITTING LOADS

BACKGROUND OF THE INVENTION

This invention relates to the regulation of power applied from an AC source to electrical loads of the heater element type.

Power regulating systems for incandescent lamps and similar electrical loads connected to an AC power source through a power switch such as a triac, are already well known as disclosed for example in U.S. Pat. No. 4,360,783 to Nagasawa et al. Such regulating systems sense the voltage across the load from which information is transmitted by a feedback loop to the actuator for the power switch, the feedback loop including a comparator receiving inputs from a synchronizing signal generator and an error threshold detector to which a load voltage sensor is connected.

The foregoing type of power regulating systems have not been entirely satisfactory in providing precision control and accommodating AC power sources having somewhat different operating frequencies, without special adjustment. Further, the lack of precision control by prior regulating systems has been aggravated by the occurrences of line voltage transients and development of excessive control signal oscillations. Attempts to correct such problems normally require complex and expensive circuit modifications.

It is therefore an important object of the present invention to provide a power regulating system of the aforementioned type which avoids the drawbacks thereof in a relatively simple and cost effective manner.

SUMMARY OF THE INVENTION

In accordance with the present invention total isolation of the regulating system from line voltage transients is achieved by use of an isolation coupling of the optical type between the load voltage sensor and the error threshold detector in the feedback loop and use of a triac driver of the opto-coupler type. As a result, the regulating system is safer and longer lasting. Greater precision is also achieved by the provision of a damping filter arrangement in the feedback loop to prevent oscillation of the triac control signal developed as a function of deviations from the effective load voltage to be maintained. Provisions are also provided to selectively reduce the effective voltage for load dimming purposes.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE DRAWINGS

Figure 1:
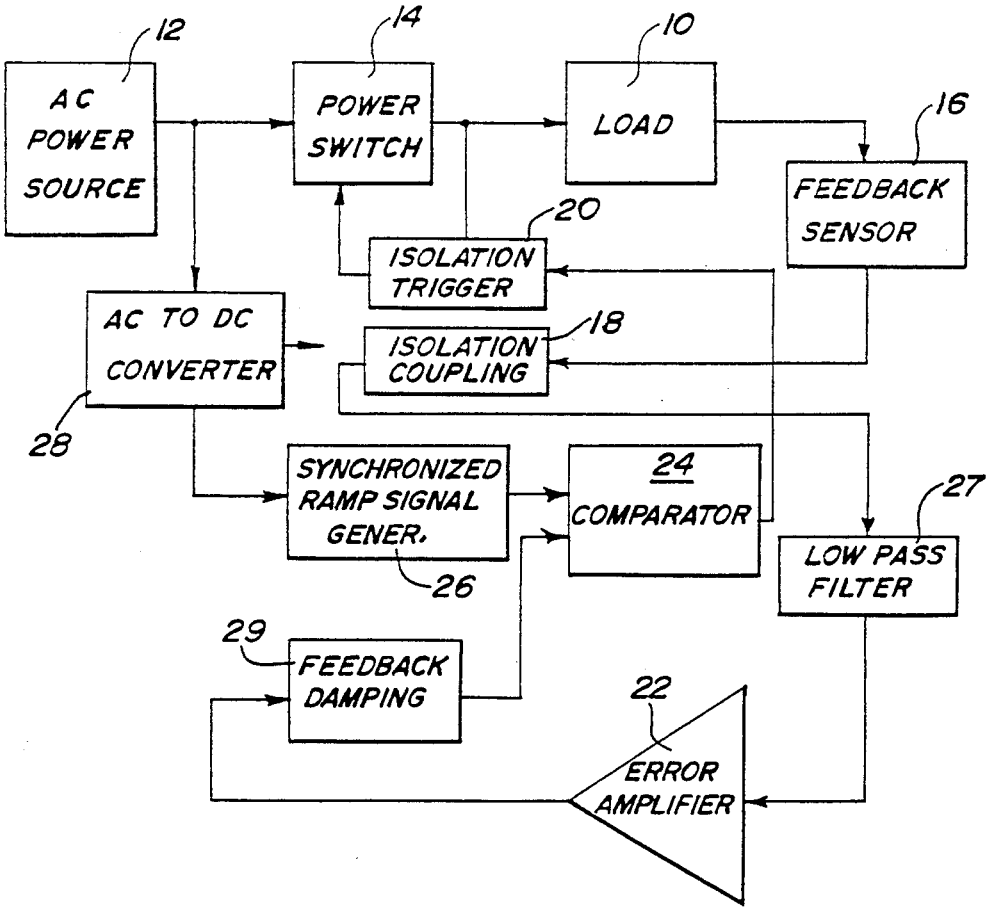
FIG. 1 is a schematic block diagram of the power regulating system of the present invention.

Referring now to the drawings in detail, FIG. 1 schematically illustrates regulation and control of a load 10 powered from an AC power source 12 to which the load is connected through a power switch 14. The effective voltage applied across the load from the power source is sensed as a RMS voltage measurement through a feedback sensor circuit 16 from which a signal output is applied to a feedback loop isolated from line voltage and transients by means of an isolation coupling 18 in cooperation with an isolation driver 20 in order to actuate the power switch 14. The regulating feedback control loop also includes an error amplifying device 22 to which the signal output of sensor circuit 16 is applied through the isolation coupling 18 and a low pass filter 27. The error amplifying device 22 is operative to detect excessive deviation of the effective voltage across the load 10 from a substantially constant nominal level despite variation of input voltage from the AC power source. An error signal output of the amplifier device 22 is applied through a feedback damping component 29 to one input of a comparator 24 to which another input is applied from a ramp signal generator 26 which is synchronized to the phase of the AC power source. An actuating signal is driven through an AC to DC converter 28 and accordingly produced by the comparator 24 and applied to the isolation trigger 20 through which the power switch 14 is operated to control the supply of power to the load 10 for maintaining the desired RMS voltage across the load. Oscillation of the actuating signal is prevented by means of a feedback damping component 29.

Figure 2:
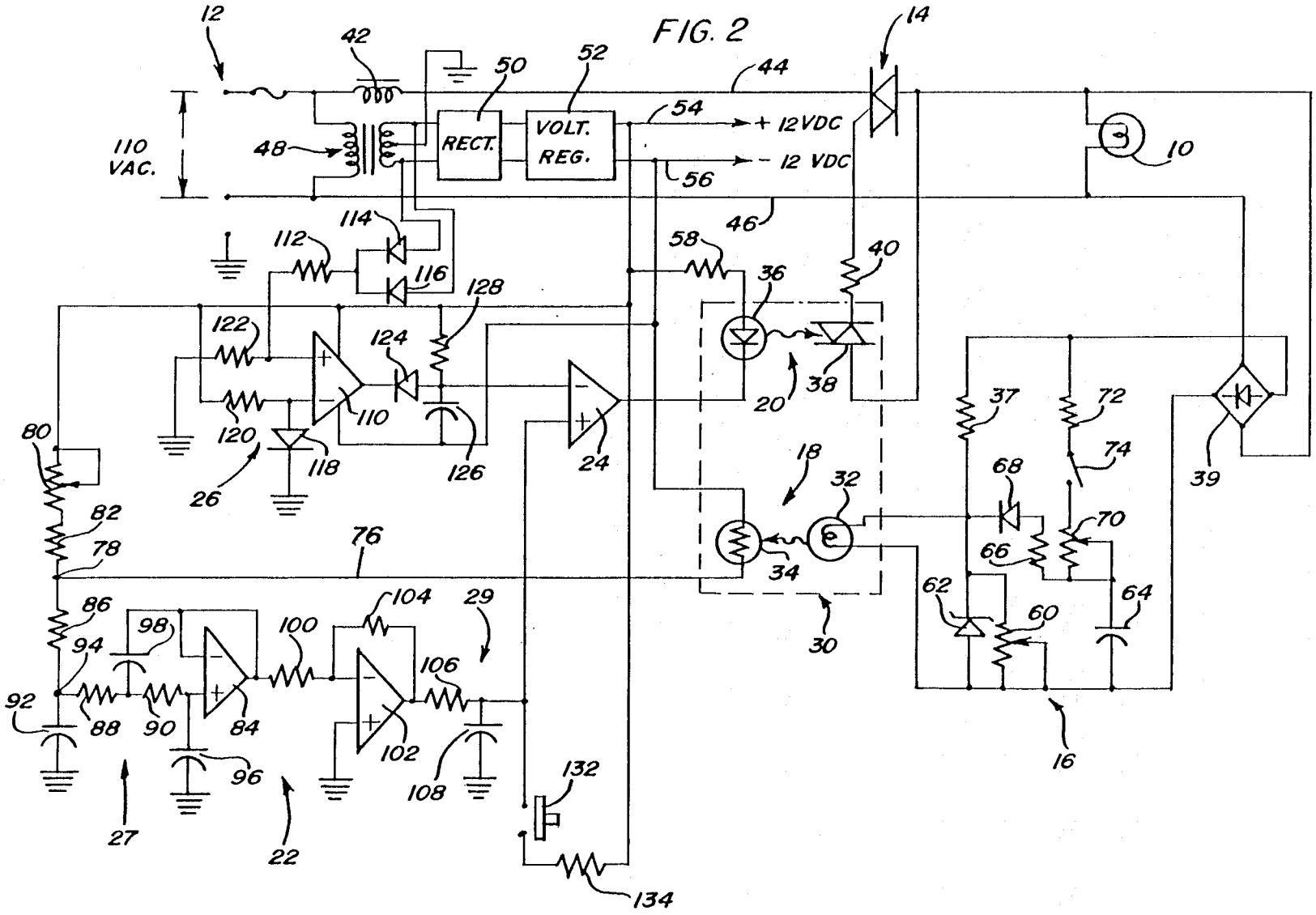
FIG. 2 is a detailed circuit diagram of the system shown in FIG. 1 in accordance with one embodiment of the invention.

Referring now to FIG. 2, it will be observed that the isolation coupling 18 and isolation trigger 20 form an assembly 30 of opto-coupling devices. One of such devices 18 includes a lamp 32 which is energized at a level to control the resistance of a photo-cell 34 in inverse relationship to the voltage across the lamp 32. The lamp 32 is connected to the sensor circuit 16 from which a feedback signal is obtained in the form of the energizing voltage applied across lamp 32 of the opto-coupling device 18. The isolation trigger 20, on the other hand, includes a light emitting diode (LED) 36 under control of comparator 24. The optical output of the LED 36 controls conduction through a solid state trigger switch 38 coupled by resistor 40 to the control electrode of a triac forming the power switch 14. The load 10 is connected by power lines 44 and 46 in series with the triac 14 and inductor 42 to the AC power source in the form of a 110 VAC supply, for example. The AC to DC converter 28 is connected across the power terminals of the AC power source and includes a voltage step-down transformer 48 applying a step-down AC voltage to a full wave rectifier 50 from which a rectified DC voltage is applied to a voltage regulator 52 providing a DC operating voltage across the DC voltage lines 54 and 56. The LED 36 of the isolation trigger 20 is coupled to tne positive DC voltage line 54 through resistor 58 while the output side of the triac power switch 14 is connected to the solid state trigger switch 38 from which the control voltage is applied through resistor 40 to the control electrode of the power switch for controlling operation thereof. By virtue of the foregoing arrangement of the isolation, trigger 20 and isolation coupling 18 of the opto-coupling assembly 30, total isolation of the regulating control circuit from line voltage transients is achieved.

The feedback sensor circuit 16 of the regulating control circuit includes an adjustable resistor 60 connected in series with the fixed resistance of resistor 37 across the DC output terminals of a bridge rectifier type of voltage sensor 39 through which the effective voltage across the load 10 is sensed and converted into a DC voltage reduced by the volt drop across resistor 37 before being applied across the filament of lamp 32 in the isolation coupling 18. Thus, by means of the adjustable resistor 60, the desired lamp voltage is selected. A Zener diode 62 is connected across the adjustable resistor 60 in order to prevent any excessive voltages from appearing across the lamp 32. A capacitor 64 is connected in series with resistor 66 and diode 68 in parallel with the adjustable resistor 60 and Zener diode 62 in order to filter out oscillations caused by severe chopping of the AC wave form voltage from the power source caused by switching operation of the triac 14. In order to reduce the energizing voltage across the lamp 32, for regulating operation of the triac 14 and energization of the lamp load 10 in a dim mode, adjustable resistor 70 is connected in series with fixed resistor 72 in parallel with the series connected resistor 66, diode 68 and resistor 37 upon closing of dimmer switch 74.

The signal voltage in line 76 from the photo cell 34, is arranged to match the DC voltage applied to junction 78 from the positive DC voltage line 54 through adjustable resistor 80 and fixed resistor 82. Thus, as long as the effective voltage is maintained across the load 10, a substantially zero voltage level will appear at junction 78 coupled through the low pass filter 27 to the non-inverting input terminal of an operational amplifier 84 in the error amplifying component 22. The low pass filter 27 includes series connected resistors 86, 88 and 90 interconnecting the junction 78 with the non-inverting input terminal of amplifier 84, a grounded capacitor 92 connected to the junction 94 between resistors 86 and 88 and a grounded capacitor 96 connected to the non-inverting input terminal of amplifier 84. A capacitor 98 couples the junction between resistors 88 and 90 to the inverting feedback terminal of amplifier 84 from which an output free of 60 cycle noise in the DC input at junction 78 is produced. The signal output of amplifier 84 stripped of 60 cycle noise, is applied through resistor 100 to the inverting input of amplifier 102 having a feedback resistor 104 innerconnecting its output with the inverting input. Thus, the amplifier 102 provides a relatively high gain for the signal produced as a result of excessive deviation of the effective voltage across the load causing a positive or negative voltage input at junction 78. The amplified error signal so produced at the output of amplifier 102 is applied through resistor 106 to the non-inverting input of the amplifier of comparator 24 to which a grounded capacitor 108 is connected. The resistor 106 and capacitor 108 form the time constant damping control 29 for the feedback loop preventing oscillation of the actuating signal output from the comparator 24. The capacitor 108 also determines the power-up characteristics of the regulating control circuit to force a hot start when power is initially applied. Accordingly, approximately 80% of the line voltage will be applied to the load initially during power-up and then be reduced to the desired effective voltage under control of the ramp signal generator 26.

The ramp signal generator 26 includes an operational amplifier 110 having its non-inverting input terminal connected through resistor 112 to a source of rectified voltage derived from the output winding of the step-down transformer 48 through recitfying diodes 114 and 116. The inverting input terminal of amplifier 110 is connected to ground through diode 118 and to the positive regulated voltage line 54 through resistor 120. The non-inverting input terminal of the amplifier 110 is maintained above ground level by grounded resistor 122. The output of amplifier 110 will thereby supply a synchronized ramp signal through diode 124 to the inverting input terminal of comparator 24. The synchronized ramp signal is effective through comparator 24 and the LED 36 of driver 20 to switch on its trigger switch 38 when the ramp signal exceeds a threshold level causing the output of amplifier comparator 24 to go low. The timing factor associated with the output of amplifier 110 is controlled by capacitor 126 and resistor 128 innerconnected at junction 130 to the inverting input terminal of comparator 24. The capacitor 126 and resistor 128 thus determine the power-up voltage applied to the isolation trigger device 20 by comparison with the threshold level determined by capacitor 108 and resistor 106, aforementioned, through the comparator 24. Such operation of the comparator may be selectively reset by momentary closing of normally open reset switch 132 connected to the non inverting input terminal of the comparater 24 and in series with resistor 134 to the positive DC voltage line 54.

Figure 3:
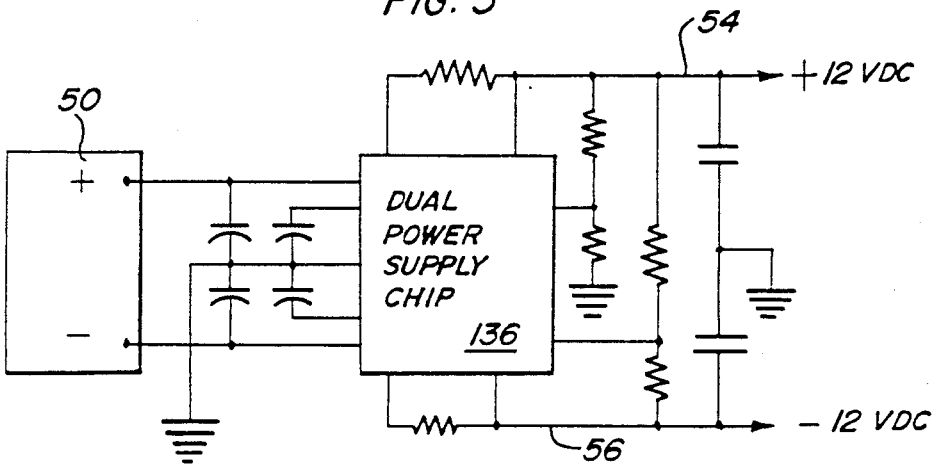
FIG. 3 is a circuit diagram of the DC voltage regulator shown in FIG. 2.

The AC power source is connected through the power regulating triac switch 14 to the load in series with the inductor 42, aforementioned, through which suppression of RF noise is achieved. The DC output voltage of rectifier 50 is regulated to provide the constant positive and negative DC voltages in lines 54 and 56 through regulator 52 which includes a dual power supply chip 136 arranged in a configuration of resistors and capacitors as shown in FIG. 3.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. In an apparatus for maintaining substantially constant electrical power through a load despite voltage changes in a power source to which the load is connected, having means for sensing an effective voltage across the load and control means for varying power applied to the load from the power source, feedback loop means operatively connecting the sensing means to the control means for regulation thereof as a function of said effective voltage including damping means for preventing oscillation of said variation in power applied and isolation coupling means operatively connected to the control means and the sensing means for isolation of the feedback loop means from the power source and the load.

2. The apparatus as defined in claim 1, wherein the control means includes a power switch connecting the source to the load, the feedback loop means further including error detection means connected by the isolation coupling means to the sensing means for amplifying excessive deviation of the effective voltage, synchronizing means connected to the source for generating a synchronizing signal and comparator means connected by the isolation coupling means to the power switch for actuation thereof under control of the synchronizing signal and said amplification of excessive deviation of the effective voltage.

3. The improvement as defined in claim 2, wherein the isolation coupling means comprises a pair of opto-coupler devices respectively connecting the sensing means to the error detecting means and the comparator means to the power switch.

4. The improvement as defined in claim 1, wherein said isolation coupling means comprises a pair of opto-coupler devices respectively connected to the sensing means and the load.

5. The improvement as defined in claim 4, wherein one of the opto-coupler devices includes a lamp energized by the sensing means as a function of said effective voltage and a photo-cell detector connected to the error detection means.

6. The improvement as defined in claim 5, wherein said other of the opto-coupler devices includes light emitting means connected to the feedback loop means for energization in synchronized relation to the power from the source and driver means responsive to said energization of the light emitting means for controlling the application of the power from the source to the load.

7. In an apparatus for maintaining electrical power through a load substantially constant despite voltage changes in a power source to which the load is connected, including means for sensing an effective voltage across the load, control means for varying power applied to the load from the power source and a feedback loop operatively connecting the sensing means to the control means, the improvement comprising a pair of isolation coupling devices respectively connecting the feedback loop to the load and to the sensing means.

8. The improvement as defined in claim 7 wherein one of the isolation coupling devices includes a lamp energized by the sensing means as a function of said effective voltage and a photo-cell detector connected to the control means.

9. The improvements as defined in claim 8, wherein the other of the isolation coupling devices includes light emitting means connected to the feedback loop for energization in synchronized relation to the power from the source and driver means responsive to said energization of the light emitting means for controlling the application of the power from the source to the load.

10. Apparatus for regulating power applied from an AC source to a load, including a power switch operatively connecting the source to the load in response to a synchronized actuating signal, means connected to the source for generating a synchronizing signal, means connected across the load for sensing load voltage, means for detecting excessive deviation of the load voltage, comparator means connected to the signal generating means and the detecting means for producing said synchronized actuating signal applied to the power switch and isolation coupling means operatively connecting the comparator means to the power switch and the sensing means to the detecting means for isolation of the comparator means from the power source and the load.

11. The apparatus as defined in claim 10, including filter means operatively connected to the coupling means for damping oscillation of the actuating signal produced by the comparator means in response to detection of excessive deviation of the load voltage.

12. Apparatus for regulating power applied from an AC source to a load, including a power switch operatively connecting the source to the load, means connected to the source for generating a synchronizing signal, means connected across the load for sensing load voltage, means for detecting excessive deviation of the load voltage, comparator means connected to the detecting means for producing a synchronized actuating signal, isolation trigger means connected to the comparator means for transmitting to the power switch said actuating signal and filter means operatively connected to the detecting means for damping oscillation of the actuating signal transmitted.

13. The apparatus as defined in claim 12, including dimmer means operatively connected to the sensing means for selectively reducing the power applied to the load from the power source.

14. The apparatus as defined in claim 13, including opto-coupling means for connecting the sensing means to the detecting means.

15. The apparatus as defined in claim 10 including opto-coupling means for connecting the sensing means to the detecting means.

16. In combination with apparatus for maintaining predetermined power through a load, including a power source applying an electric voltage signal to the load, sensor means for sensing an effective voltage across the load, means for producing an output voltage as a function of said sensed effective voltage and regulator means for varying said electric voltage signal in response to an output signal corresponding to the output voltage, said means for producing the output voltage including an isolation coupling and feedback control means connected between the isolation coupling and the regulator means for damping oscillations produced by deviations of the effective voltage sensed to produce said output signal applied to the regulator means, thereby maintaining the predetermined power through the load with precision.

* * * * *